US007594463B2

(12) United States Patent
Skinner

(10) Patent No.: US 7,594,463 B2
(45) Date of Patent: Sep. 29, 2009

(54) EVAPORATIVE BARREL COOLER

(76) Inventor: Stanley Skinner, 2812 W. Wagonwheel Dr., Tucson, AZ (US) 85745

( * ) Notice: Subject to any disclaimer, the term of this patent is extended or adjusted under 35 U.S.C. 154(b) by 288 days.

(21) Appl. No.: 11/208,332

(22) Filed: Aug. 19, 2005

(65) Prior Publication Data

US 2007/0039224 A1 Feb. 22, 2007

(51) Int. Cl.
*F41A 13/04* (2006.01)
*F41A 13/12* (2006.01)

(52) U.S. Cl. ..... 89/1.2; 89/14.1

(58) Field of Classification Search ..... 89/14.1, 89/1.2; 42/90, 106
See application file for complete search history.

(56) References Cited

U.S. PATENT DOCUMENTS

| | | | | | |
|---|---|---|---|---|---|
| 940,101 | A * | 11/1909 | Wetzel | 89/1.2 |
| 1,128,639 | A * | 2/1915 | Tsukalas | 89/1.2 |
| 1,350,645 | A * | 8/1920 | Eickhoff | 89/125 |
| 1,388,854 | A * | 8/1921 | Dezendorf | 15/406 |
| 2,094,854 | A * | 10/1937 | Smith | 89/7 |
| 2,764,914 | A * | 10/1956 | Young | 89/14.1 |
| 2,791,940 | A * | 5/1957 | Speake et al. | 89/1.2 |
| 3,346,984 | A * | 10/1967 | Lohr | 42/55 |
| 3,536,160 | A * | 10/1970 | Brewer | 184/109 |
| 3,814,525 | A * | 6/1974 | Spencer | 401/190 |
| 4,783,925 | A * | 11/1988 | Pollock, Jr. | 42/90 |
| 5,511,456 | A * | 4/1996 | Faughn | 89/1.2 |
| 6,023,873 | A * | 2/2000 | Baird | 42/95 |
| 6,308,899 | B1 * | 10/2001 | Crofford | 239/373 |
| 6,386,293 | B1 * | 5/2002 | Bartlett | 169/47 |
| 6,564,789 | B1 * | 5/2003 | Hu | 124/66 |
| 6,668,480 | B1 * | 12/2003 | Riley | 42/95 |
| 6,695,228 | B2 * | 2/2004 | Odessa | 239/337 |
| 2003/0019954 | A1 * | 1/2003 | Clarke | 239/333 |
| 2004/0069817 | A1 * | 4/2004 | Jacques | 222/529 |
| 2005/0194024 | A1 * | 9/2005 | Wadsworth et al. | 134/26 |
| 2005/0274743 | A1 * | 12/2005 | Barefoot | 222/190 |
| 2006/0218735 | A1 * | 10/2006 | Parker-Smith | 15/104.05 |
| 2007/0034709 | A1 * | 2/2007 | Daniel | 239/146 |
| 2007/0084422 | A1 * | 4/2007 | Vaughan | 122/451 R |

FOREIGN PATENT DOCUMENTS

DE 4022542 A1 * 1/1992

* cited by examiner

*Primary Examiner*—Troy Chambers
(74) *Attorney, Agent, or Firm*—Timothy M. Barlow

(57) ABSTRACT

An evaporative barrel cooler for a firearm includes a firearm adapter having a mist nozzle, and a high pressure coolant reservoir attached to the firearm adapter with a flexible hose. The firearm adapter orients the nozzle inside a firearm chamber and aligned with the bore of a firearm barrel. The firearm adapter conforms to the interior of a firearm action and replaces a firearm bolt. The firearm adapter accesses the chamber through an open action port or through the bolt's raceway. The high pressure coolant reservoir may further include a hand pump attached to the reservoir for pressurizing the coolant. A coolant valve may be incorporated into the flexible hose to control the flow of coolant, whether it is water, alcohol, gunpowder or bullet metal solvent, or a nonflammable and nonreactive material.

14 Claims, 4 Drawing Sheets

EVAPORATIVE BARREL COOLER

BACKGROUND OF THE INVENTION

1. Field of the Invention

The present invention relates generally to evaporative cooling systems, and more specifically to a mist cooling system for firearms.

2. Description of Related Art

Evaporative cooling systems take advantage of the tremendous amount of energy required to convert a liquid into a gas. This phase change absorbs a lot of energy, thus, the surrounding environment and materials are cooled. This principle has been used in evaporative coolers for dwellings for decades. The evaporative cooler, or swamp cooler, uses water as the coolant medium. The water is passed through and into a medium with a large surface area, such as a foam, sponge or porous filter pad. A fan draws air through the water-laden porous filter pad and some of the water evaporates. The evaporation of water requires a lot of energy and causes the air to be cooled. More recently, misting devices have been used to spray a finely atomized mist of water onto a person to cool the skin and increase comfort as the water mist evaporates. However, such coolers and misting devices are useful only for large areas and external surfaces.

Firearms present a particularly difficult problem. Sustained or prolonged firing makes the barrel too hot to touch. This condition can be aggravated by high ambient temperature conditions, no wind conditions and direct sunshine. High barrel temperatures make a firearm uncomfortable to handle, but other problems can result. Barrel materials, such as steel, expand in response to being heated. This, of course, is normal. However, such heating is rarely linear and evenly distributed. Typically, a barrel will warp or twist as it heats, due to unevenly distributed stresses inherent in the materials during manufacturing. Obviously, a warped or twisted barrel is not conducive to optimal accuracy. Other problems can arise from overheated barrels as well. When a barrel is too hot, a cartridge in the chamber may discharge spontaneously, or cook off. This occurs because the temperature inside the cartridge is high enough to ignite the propellant inside the cartridge. The firearm's lock mechanism is rendered irrelevant. This condition is quite dangerous. Another problem has to do with barrel longevity. Each time a firearm is fired, the hot gasses and plasma from the cartridge's propellant cut and etch the interior of the barrel. This action erodes the precision-machined throat of the barrel, just ahead of the chamber. Unchecked, the barrel erosion process completely destroys a barrel from the inside out. High barrel temperatures can aggravate the erosion process. Thus, temperature control of a firearm barrel is important for sustained accuracy and longevity.

Numerous barrel-cooling devices have been developed over the years. The earliest devices included a water jacket that was attached around machine gun barrels used by our armed forces. This system included a tube over and around virtually the entire barrel. The tube contained water or another liquid coolant and held it in direct contact against the exterior of the barrel. A small reservoir was attached to the jacket via a hose to provide cool water as the water in the jacket heated up. After sustained firing of the firearm, the water could be near boiling. This illustrates how much heat needs to be dissipated, however, the water jacket had some drawbacks. Not only was the water jacket idea heavy, but the hot water could cause burns. Further, the system was potentially fragile and depended upon a watertight jacket that could withstand the rigors of combat use. If no water could be found, or if the supply was exhausted, the jacket trapped heat in the barrel, contrary to the designer's intent.

Another solution was a heat exchanger array. The heat exchanger arrays increased the surface area of the barrel and were attached directly to the barrel to provide addition surface area, in the form of numerous cooling fins. The problem with cooling fins is that they can clog with debris rather easily, like an automotive radiator. The fins could also be very easy to bend or deform. Like the malfunctioning water jacket, a clogged cooling fin array traps heat better than it dissipates heat. The shortcomings of the cooling fin array led to barrel fluting as a solution.

A fluted firearm barrel incorporates a cooling solution directly onto the external surface of the barrel. Grooves, typically longitudinal, are cut into the surface of the barrel to increase the surface area of the barrel. Those grooves are called flutes. However, surface area increases due to fluting are typically very small, unless a large number of very deep cuts are made in the barrel. Any kind of fluting can have drawbacks, however. Like the water jacket and the cooling fins, barrel fluting requires an adequate flow of cooling air to remove the excess heat. In addition, barrel fluting can actually alter the interior dimensions of the barrel as it removes material from the outside of the barrel. As a result, for maximum accuracy, any fluting should be made prior to finishing the bore of the barrel. Thus, it might not be a good idea to add fluting to barrels that are already in use.

None of these devices make it easy to quickly and safely reduce the temperature of a firearm barrel, without requiring complicated, heavy or fragile equipment. Thus, what is needed is a way to quickly, easily and cheaply cool firearm barrels from the inside without altering the barrel or firearm, and without compromising its reliability.

SUMMARY OF THE INVENTION

The device is a mist cooling system for firearms, which includes a firearm adapter having a mist nozzle, and a high pressure coolant reservoir attached to the firearm adapter with a flexible hose. The firearm adapter orients the nozzle inside a firearm's chamber so that it is aligned with a bore of the firearm's barrel. The firearm adapter conforms to an interior of a firearm action. The firearm adapter is inserted in place of the firearm's bolt or through an open action port.

Accordingly, it is a principal object of the invention to disclose a mist cooling system for firearms that allows a shooter to quickly and safely cool a hot firearm barrel from the inside.

It is another object of the invention to teach a mist cooling system for firearms that may be used with any type of firearm action.

Still another object of the invention is to teach a mist cooling system for firearms that requires only a small amount of coolant.

Yet another object of the invention is to disclose a mist cooling system for firearms that permits a firearm to be used immediately after cooling.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE DRAWINGS

The following detailed description is of the best presently contemplated modes of carrying out the invention. This description is not to be taken in a limiting sense, but is made merely for the purpose of illustrating general principles of embodiments of the invention.

Figure 1:
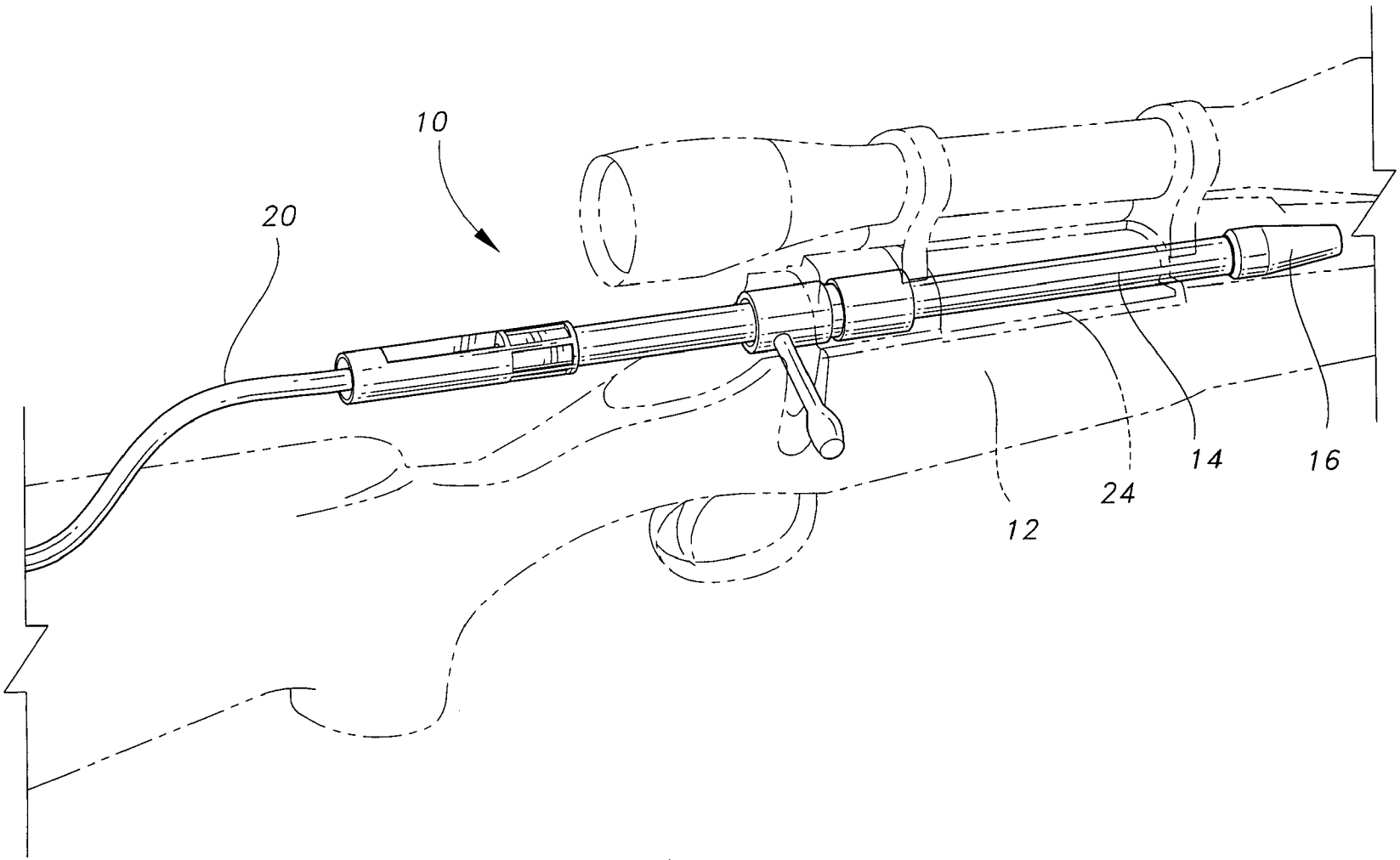
FIG. 1 is a perspective view of a mist cooling system for firearms, according to the present invention.
Figure 2:
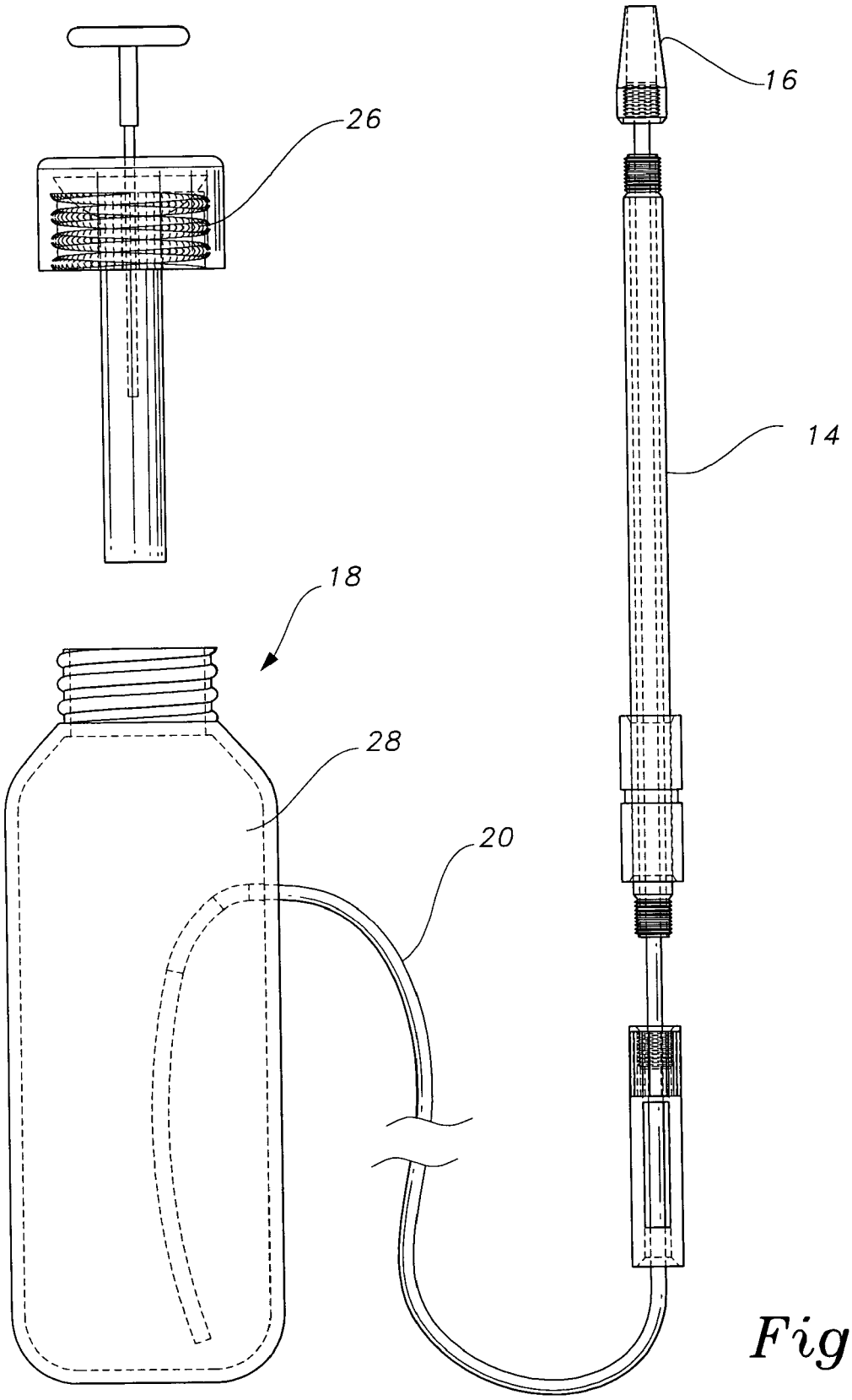
FIG. 2 is a side view of the mist cooling system for firearms, according to the present invention.

FIG. 1 shows a perspective view of the mist cooling system for firearms 10 inside a bolt-action firearm 12 with the bolt removed. The evaporative barrel cooler for a firearm 10 includes a firearm adapter 14 having a mist nozzle 16. A high pressure coolant reservoir 18, see FIG. 2, is attached to the firearm adapter 14 with a flexible hose 20. The firearm adapter 14 orients the nozzle 16 inside the firearm's chamber and aligned with the bore of the firearm's barrel. The nozzle 16 includes a very small aperture that atomizes the coolant as it exits the nozzle 16. As shown in FIG. 1, the firearm adapter 14 conforms to the interior of a firearm's action. In FIG. 1, the firearm 12 is a bolt action rifle, and the bolt has been removed. The firearm adapter 14 has unimpeded access from the rear of the action through to the chamber and barrel. Thus, the firearm adapter 14 may be made to replace a firearm bolt.

Figure 3:
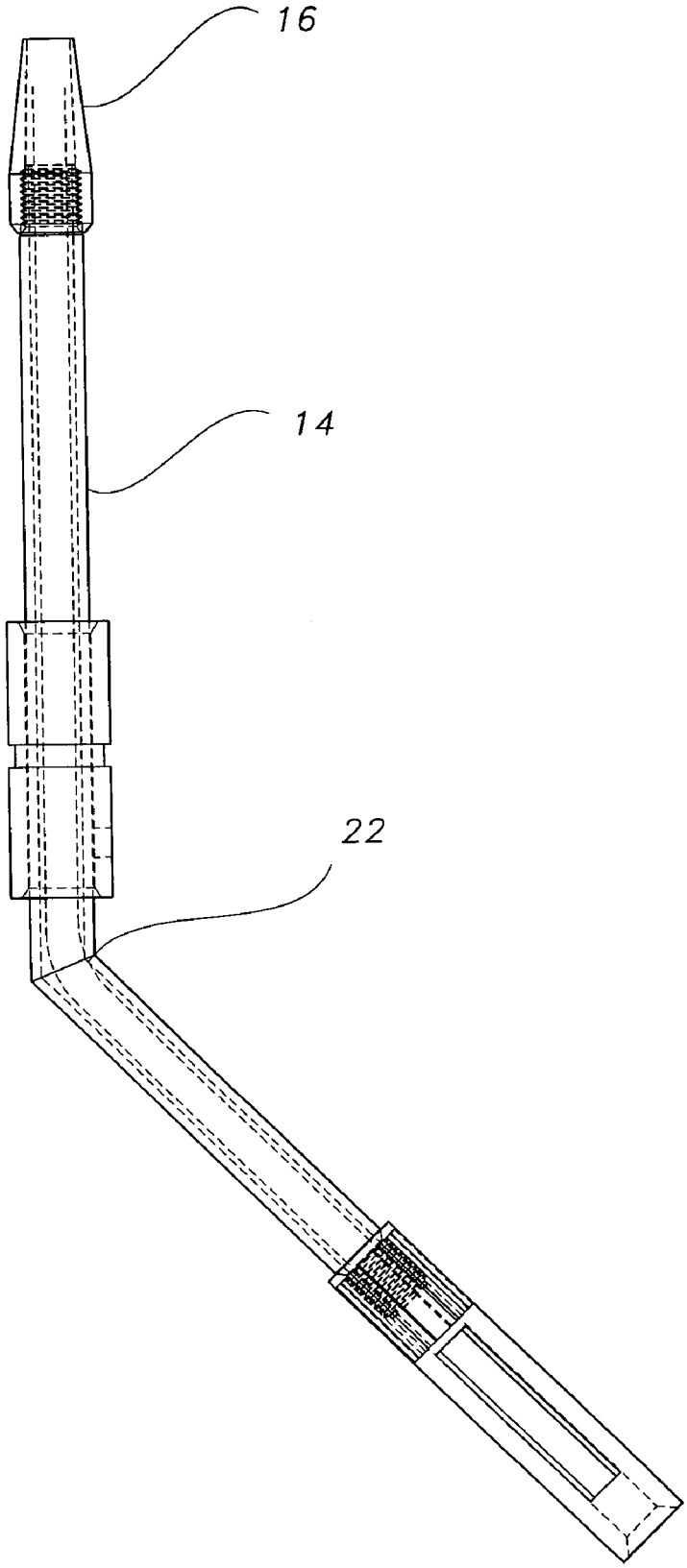
FIG. 3 is a side view of an angled firearm adapter for the mist cooling system for firearms, according to the present invention.
Figure 4:
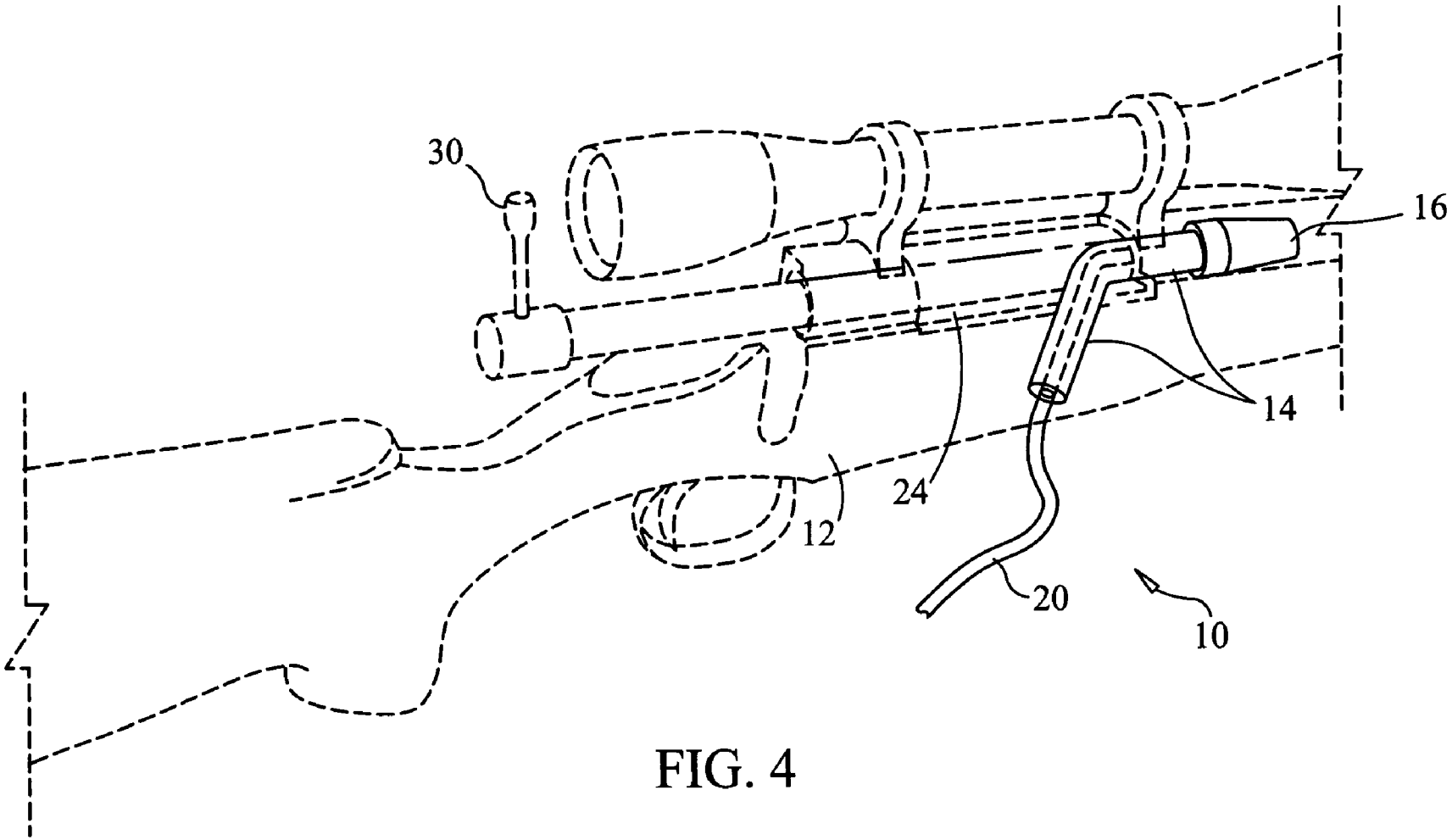
FIG. 4 is a perspective view of a mist cooling system for firearms having an angled firearm adapter, according to the present invention.

In another embodiment, the firearm adapter 14 accesses the chamber through an open action port, see FIGS. 3 and 4. FIG. 3 shows a firearm adapter 14 that includes an angle 22. The angle 22 permits the firearm adapter 14 to be inserted into the loading or ejection port 24 in virtually any type of firearm action. Thus, in a bolt action firearm 12, the bolt 30 would not need to be removed to insert the firearm adapter 14. See FIG. 4. In addition, the angled 22 firearm adapter 14 can be used in virtually any other type of firearm action, including self-loading firearms, lever-action firearms and other firearms that lack the straight-through access of a bolt-action firearm.

FIG. 2 shows a partially disassembled view of the mist cooling system for firearms. The firearm adapter 14 has a nozzle 16 attached at a first end and a hose 20 attached at a second end. The various parts may be formed as a unit or as separable parts for easier cleaning and maintenance. The mist cooling device 10 may be made from a variety of materials, including plastics and brass or other metals.

The high-pressure coolant reservoir 18 includes a hand pump 26 that attaches onto the bottle 28. The hose 20 supplies high-pressure coolant through the firearm adapter 14 and to the nozzle 16. As the high pressure coolant is released through the nozzle 16, the coolant is atomized and sprayed into the firearm barrel. Only a small amount of coolant is necessary to cool a hot firearm barrel. The coolant undergoes a phase change from a liquid to a gas as it encounters the hot barrel. This maximizes the cooling effect provided by the coolant and leaves very little, if any, liquid coolant behind. What little liquid coolant remains evaporates quickly or is easily removed with a dry cleaning patch. For ease of use, a simple on-off control valve can be incorporated into the hose 20 to control the flow of coolant through the firearm adapter 14. A collar may be included around the firearm adapter 14 to center the adapter 14 inside the firearm. Various sized collars can be made to conform to a wide variety of firearms, or the collar may be made to fit virtually all firearms. In a similar manner, the nozzle 16 may be made in a smaller diameter to fit a wide variety of firearm chambers, or nozzles 16 may be made fit a specific cartridge chambering or a family of cartridge chamberings.

The coolant can be water, or other suitable liquids, such as alcohol, but the user should ensure that the coolant does not contain dissolved minerals or other compounds which can harm a firearm. For example, distilled water is a good idea so as to eliminate the mineral content of tap water or ordinary drinking water. Alcohol is, of course, flammable, and needs to be used with care. The optimal coolant is nonflammable, inert and will not harm a firearm, either mechanically or cosmetically. Such a coolant should be nonreactive with barrel materials. Water is commonly available, and is readily available in its distilled form. Any adverse effects of water are easily dealt with when the firearm is cleaned and maintained.

Another use for the device is as an aid to barrel cleaning whereby the coolant does double duty as a cleaning agent. Traditionally, barrel cleaning is accomplished with a cleaning rod and cloth patches soaked with a solvent. There is the possibility of barrel damage any time a cleaning rod is inserted through a barrel, due to mechanical contact and abrasion. Thus, barrel cleaning solvents, such as powder solvents or lead and copper solvents could be used in the misting device to provide a mist of the desired solvent into the barrel. Such a solvent delivery system would be a benefit to shooters in several ways. First, the solvent could be applied quickly and easily without the use of a traditional cleaning rod with a cloth patch. This solution eliminates the possibility of barrel bore damage which can happen when you place anything through the bore. Second, solvent mist can make the barrel easier to clean. The solvent can be applied immediately after firing, while the powder fouling or metal fouling is still warm. Many solvents will keep the powder fouling soft and make it much easier to remove. Metal solvents will start the deep-cleaning process right away. Thus, even if the shooter is unable to clean the firearm right away, a cleaning solvent will already be applied and will be working toward a clean barrel.

While the description above refers to particular embodiments of the present invention, it will be understood that many modifications may be made without departing from the spirit thereof. The accompanying claims are intended to cover such modifications as would fall within the true scope and spirit of the present invention.

I claim:

1. A firearm having an evaporative barrel cooler, comprising:

a firearm action having an attached barrel with a chamber;

a firearm adapter for the evaporative barrel cooler inserted into an interior of the firearm action and having a mist nozzle, wherein the firearm adapter conforms to the interior of the firearm action, and orients the nozzle inside the chamber so that the nozzle is aligned with a bore of the barrel; and a coolant reservoir attached to the firearm adapter with a hose.

2. The evaporative barrel cooler of claim 1, where the firearm adapter replaces a firearm bolt.

3. The evaporative barrel cooler of claim 1, where the firearm adapter accesses the chamber through an open action port.

4. The evaporative barrel cooler of claim 1, where the coolant reservoir further comprises a hand pump attached to the reservoir.

5. The evaporative barrel cooler of claim 1, further comprising a coolant valve incorporated into the hose.

6. The evaporative barrel cooler of claim 1, where the coolant is water.

7. The evaporative barrel cooler of claim 1, where the coolant is an alcohol.

8. The evaporative barrel cooler of claim 1, where the coolant is nonflammable.

9. The evaporative barrel cooler of claim 1, where the coolant is nonreactive with barrel materials.

10. The evaporative barrel cooler of claim 1, where the coolant is a gunpowder solvent.

11. The evaporative barrel cooler of claim 1, where the coolant is a bullet metal solvent.

12. A firearm having an evaporative barrel cooler comprising:

a firearm action having an attached barrel and a chamber;

a firearm adapter for the evaporative barrel cooler inserted into an interior of the firearm action and having a mist nozzle at a first end, wherein the firearm adapter conforms to an interior of the firearm action, and orients the nozzle inside the chamber so that the nozzle is aligned with a bore of the barrel;

a coolant reservoir attached to the firearm adapter at a second end with a hose;

a hand pump attached to the reservoir; and a coolant valve incorporated into the hose.

13. The evaporative barrel cooler of claim 12, where the firearm adapter replaces a firearm bolt.

14. The evaporative barrel cooler of claim 12, where the firearm adapter accesses the chamber through an open action port.

* * * * *